US008757390B2

(12) United States Patent
Masferrer Salas

(10) Patent No.: US 8,757,390 B2
(45) Date of Patent: Jun. 24, 2014

(54) MAGNETIC ROLLER TYPE SEPARATING DEVICE

(75) Inventor: David Alejandro Masferrer Salas, Santiago (CL)

(73) Assignee: Superazufre S.A., Santiago (CL)

( * ) Notice: Subject to any disclaimer, the term of this patent is extended or adjusted under 35 U.S.C. 154(b) by 68 days.

(21) Appl. No.: 13/391,118

(22) PCT Filed: Sep. 6, 2010

(86) PCT No.: PCT/CL2010/000035
§ 371 (c)(1),
(2), (4) Date: Jul. 13, 2012

(87) PCT Pub. No.: WO2011/020207
PCT Pub. Date: Feb. 24, 2011

(65) Prior Publication Data
US 2012/0279906 A1 Nov. 8, 2012

(51) Int. Cl.
*B03C 1/00* (2006.01)

(52) U.S. Cl.
USPC ..... 209/213; 209/215; 209/219

(58) Field of Classification Search
USPC ..... 209/213, 215, 219, 228, 229
See application file for complete search history.

(56) References Cited

U.S. PATENT DOCUMENTS

| | | | | |
|---|---|---|---|---|
| 3,028,708 | A * | 4/1962 | Vaughan et al. | 451/93 |
| 4,834,871 | A * | 5/1989 | Schnabel et al. | 209/219 |
| 5,207,330 | A * | 5/1993 | Siesco, Jr. | 209/219 |
| 5,394,991 | A | 3/1995 | Kumagai et al. | |
| 5,636,748 | A * | 6/1997 | Arvidson | 209/223.2 |
| 6,041,942 | A | 3/2000 | Goolsby | |
| 6,068,133 | A * | 5/2000 | Schonfeld et al. | 209/219 |
| 2003/0196935 | A1* | 10/2003 | Miles et al. | 209/219 |
| 2008/0164184 | A1* | 7/2008 | Marston et al. | 209/219 |
| 2009/0314690 | A1* | 12/2009 | Molteni | 209/214 |

FOREIGN PATENT DOCUMENTS

EP 951940 A3 2/2000

OTHER PUBLICATIONS

International Search Report mailed May 17, 2011, which issued in corresponding International Patent Application No. PCT/CL2010/000035.

* cited by examiner

*Primary Examiner* — David H Bollinger
(74) *Attorney, Agent, or Firm* — Fish & Richardson P.C.

(57) ABSTRACT

Since Thomas Edison invented the magnetic roller separator for concentrating nickel mineral, drum and roller type separators have become the most common magnetic separators. These devices can be constructed with permanent magnets or with electromagnets, and the drum separator can operate with a dry or wet supply. However, still today, strongly magnetic material detaching from the roller is a problem that has been tried to be resolved by introducing the magnets inside the cylinders, in only one area thereof, in such a way that when the material is rotated on the cylinder and moves away from the magnetised area, it falls as a result of gravity. This system has a highly complex structure. The invention uses novel and powerful, very small neodymium magnets to cover the entire surface of the roller. In this way, a small device with a larger yield is produced in a very simple and economic manner. The particulate material to be separated is supplied over a plastic piece covering the magnetic roller that is in contact with same only over a fraction of the circumference, such that when the plastic piece moves away from the magnetic roller, the material falls as a result of gravity and is separated from the rest by means of a deflector.

9 Claims, 2 Drawing Sheets

MAGNETIC ROLLER TYPE SEPARATING DEVICE

CROSS REFERENCE TO PRIOR APPLICATIONS

This is the U.S. National Phase under 35 U.S.C. §371 of International Patent Application No. PCT/CL2010/000035, filed Sep. 6, 2010, and claims the priority of Chilean Patent Application No. 1763-2009, filed Aug. 21, 2009. Each of the aforementioned applications is hereby incorporated by reference herein in its entirety. The International Application published in Spanish on Feb. 24, 2011 as WO 2011/020207 A2 under PCT Article 21(2).

FIELD OF APPLICATION

This invention refers to a separator of the magnetic type focused on nonmagnetic or weakly paramagnetic ores, applied to the concentration of ores and other particulate materials.

DESCRIPTION OF WHAT IS KNOWN IN THE FIELD

The principles of magnetic separation have been applied commercially for more than 100 years. These applications go from simple separations, such as the removal of coarse particles of iron, to more sophisticated separations, such as the elimination of fine particles of clay that are barely stained with iron and that are weakly magnetic, in order to calendar paper.

An important part of these magnetic separators is the stage when magnetic fractions are detached to separate the products, which is as important as their magnetic attraction stage. This is achieved in different ways in the various equipments known. One very common form is that in which the magnets are not placed along the entire circumference of the magnetic roller, but only on a fraction of it, which is usually 180 sexagesimal degrees or even less. This value is determined according to the parameters of the particular system to be separated, and in general is not very versatile. Once the products have become detached, the very magnetic particles remain attached in the magnetized part of the magnetic roller and need to be detached mechanically with brushes, scrapers or other cleaning equipment.

Magnetic separators currently have a large variety of applications in industry and they are manufactured in various sizes that go from small scale laboratory devices to equipment that can process hundreds of tons per hour.

Generally speaking, the magnetic separators that have been used to date employ electromagnets or large-size permanent magnets, in moderate amounts, whose installation is complex, even taking into account the orientation of the magnetic poles of the magnets.

The application of the methods of separation by means of magnetic rollers to weakly magnetic particles has been possible thanks to the progress in the design of magnetic separation equipment.

In Chile, application 00010/2006 describes a separator having two rollers of the same diameter, in which one is magnetic and the other is powered nonmagnetic, both joined by a conveyor belt. Another of the applications presented in Chile is 00585/1981 that claims a roller of magnetic layers alternating concentrically with ferromagnetic layers that also alternates its polarities and that cover only 30% of the roller.

In the world some patent applications are described such as US 2005/0092656 A1 that also includes an electrostatic separator; WO 88/05696 A1 that uses permanent magnets in one sector of the roller, but that do not move with it but rather, remain fixed in space; WO 2005/042168 A1 that also includes an electrostatic separator; and Russian application RU 2220774 C2 that uses a magnetic drum with a surface grooved in the direction of the generatrix whose particularity is that the axis of the drum is inclined in a vertical plane thereby obtaining better efficiency and reliability.

DESCRIPTION OF THE INVENTION

A magnetic separator, of the type that has a magnetic roller for separating nonmagnetic, moderately paramagnetic and weakly paramagnetic particulate matter, via a dry process with improved characteristics, greater magnetic strength and induction, easy to manufacture and operational versatility.

In this invention a separator of the magnetic type is described that focuses on nonmagnetic or weakly paramagnetic ores as is the case of the mineral referred to in this invention, apatite, a nonmetallic mineral that is found in conjunction associated with minerals of the class of silicates of the group of the amphiboles, such as, for example, anthophyllite, tremolite, actinolite, among others, in which the action of the magnetic force exercised by a magnet to the latter is very low or mostly weak in comparison with magnetic minerals as is the case of Iron.

In this invention, emphasis is placed on the configuration of the magnets that are randomly distributed in space, with their magnetic axes perpendicular to the radial axis of the metal traction roller, on their shape, as is the case of the example mentioned later in this invention, circular or another geometric shape; square, triangular, etc. With a magnetic induction typically of 12,000 Gauss or higher and a magnetic force higher than 4,500 Gauss and at the speed of rotation of the metal traction roller given that the magnetic force exercised by the action of these magnets specifically their edges which is where the largest number of magnetic field lines is concentrated, and a fundamental principle of this invention and in conjunction with the action of the angular speed of the traction roller, bring about the separation of this type of ore in particular, on one side the non metallic ore, Apatite, separated from the actinolite ore as the traction roller transfers a centrifugal force to said particle thus causing it to be ejected in the first contact with the traction roller which is not the case of the mineral of the amphibole group because the particle is attracted weakly by the edges of the magnets installed and/or by the action and configuration of the magnets bringing about a delayed or weak jump in this mineral in particular, thus achieving a separation or concentration of the minerals used for the case of this invention.

With regard to the installation of the magnets in the traction roller, these are installed without forcing the position of the magnetic poles and adhered only by the action of the magnetic field force of the magnets on the traction roller. Typically, without affecting the generality of the invention, with magnets of minute measurements that may be, as in the case of the example mentioned later, magnets of 5 mm in diameter.

With regard to the metal traction roller, it is covered for about 200 sexagesimal degrees by a surfacing of nonmagnetic plastic material, that also partially encloses the pulley and the tensioning roller, the latter to vary the emergence angle in about 45 sexagesimal degrees from the vertical of the axis of the metal traction roller, separating the moderately paramagnetic ore from the weakly paramagnetic ore, causing in one way or another that the separations of minerals by means of the deflector are as distant as possible from the different degrees of magnetism (Moderately paramagnetic, weakly paramagnetic and nonmagnetic).

Figure 1:
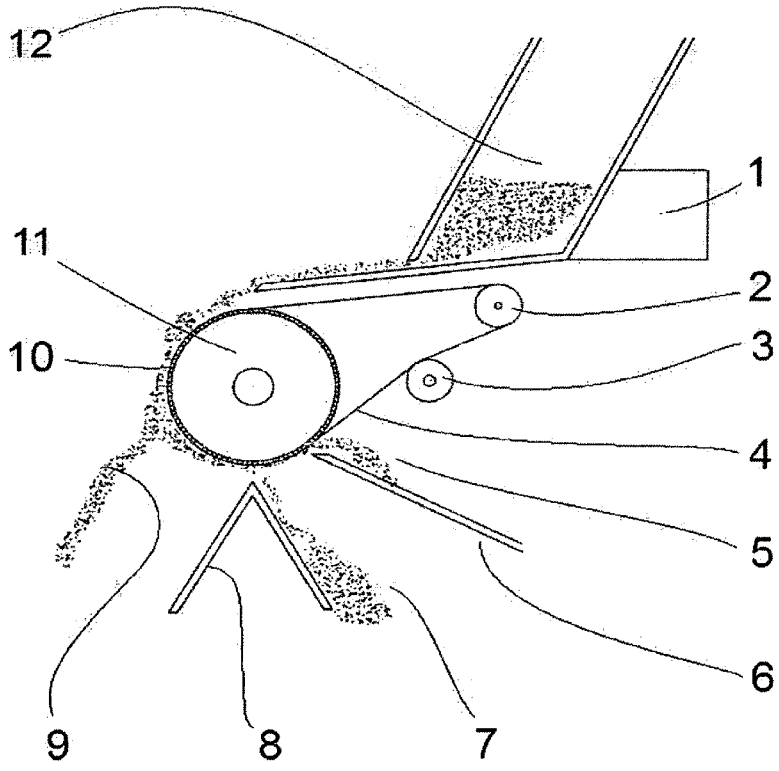
FIG. 1 shows an exploded view of the magnetic separating equipment.

The numbers indicated in the figures all have the following meaning:

1. Vibrator motor
2. Pulley
3. Tensioning device
4. Plastic surfacing
5. Drop zone of moderately paramagnetic material
6. Deflector
7. Drop zone of weakly paramagnetic material
8. Dividing guide
9. Drop zone of nonmagnetic material
10. Magnets
11. Metal traction roller
12. Feeder

PREFERRED WAY OF CARRYING OUT THE INVENTION

Figure 2:
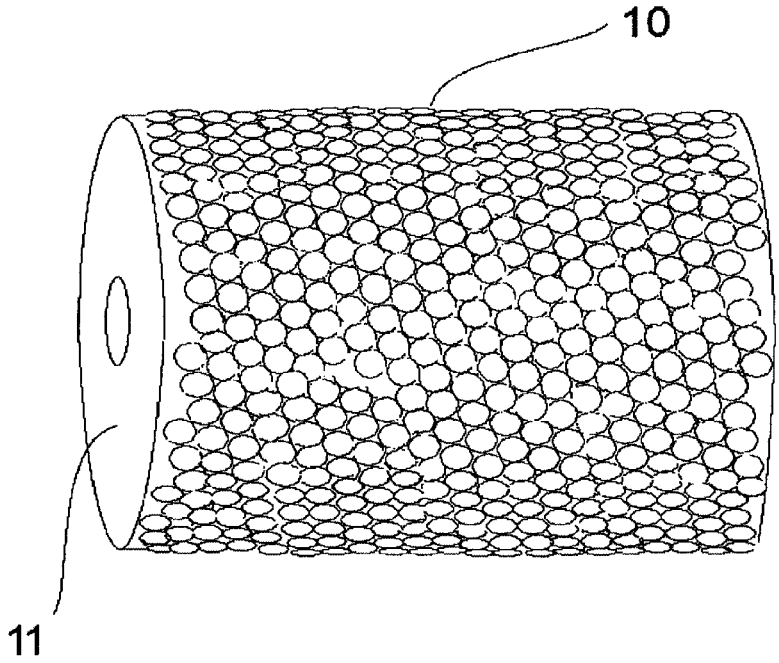
FIG. 2 shows an exploded view in perspective of the metal traction roller and its magnets positioned in its entire mantle.

The separating equipment of this invention consists of a feeder of particulate material (12), material that flows only by gravity or with the help of the vibrator motor (1) on the upper area of the metal traction roller (11), which rotates in the direction in which the particulate material is fed. The entire surface of the metal traction roller is covered with a plurality of permanent magnets, their shape or size is not important (10), whose distribution on the surface is illustrated in FIG. 2, with their magnetic axes perpendicular to the radial axis of the traction roller.

The metal traction roller (11) is covered in at least half of its circumference, by a surfacing of nonmagnetic material that, in this description, without prejudice to the generality, is described as a closed plastic coating (4) that also partially covers the pulley (2), and that is kept taught between the roller (11) and the pulley (2) due to the action of the tensioning device (3).

In the inferior zone of the metal traction roller (11) there is a dividing guide (8) whose functionality is to separate the fractions of material resulting from the operation of this equipment.

Between the position of the dividing guide (8) and the tensioning device (3) there is a deflector (6) whose function is to pick up the fraction of moderately paramagnetic material that comes off the metal traction roller (11) because of the action of the surfacing (4) that distances it from the magnetic attraction of the magnets located on the surface of the mantle of the metal traction roller (11).

As the metal traction roller (11) rotates it transmits a centrifugal force to the particulate material that is fed onto its surface, which causes the nonmagnetic material to come off its surface and fall due to the pull of gravity onto the drop zone of nonmagnetic material (9).

In the case of the weakly paramagnetic materials, when the action of the magnetic force is lower than the joint action of the forces of gravity and the centrifugal force, the latter graduated by controlling the rotation speed for this effect, the dropping of the weakly paramagnetic particles is delayed causing them to come off and fall in the drop zone of weakly paramagnetic material (7).

In the case of moderately paramagnetic particulate material, the magnetic force is able to maintain the particles adhered, in spite of the action of gravity and of the centrifugal force and they are only removed when the magnetic attraction ceases, because the particles have been distanced from the action of the magnets (10), by action of the plastic coating (4), sliding down the deflector (6) and accumulating in the drop zone for moderately paramagnetic material (5).

One advantage of the nonmagnetic coating is that it distances the moderately paramagnetic particles from the magnets and the particles fall and the coating remains clean, making it unnecessary to consider special additional objects for cleaning such as a brush or scrapers.

Because the entire mantle of the metal traction roller (11) is covered with magnets (10), the rotation speed can be varied over a wide range and therefore generate the adequate centrifugal force over the nonmagnetic or weakly paramagnetic particles that one wishes to separate.

To sum up, to separate the different fractions of material, the centrifugal force generated by the rotation of the roller must be greater than the magnetic force exercised towards the particle that one wishes to separate and must be less than the magnetic force exercised towards the particle with the highest degree of magnetism.

EXAMPLE OF APPLICATION

Without discrediting the generality of the invention, for the purpose of describing one of its applications, this will be made with reference to a laboratory-scale roller separator of this invention, 110 mm in diameter by 90 mm in length, to which about 5.000 neodymium disc-shaped magnets, 5 mm in diameter by 3 mm high, were adhered only by magnetic force; the magnets were covered with a sleeve made of plastic material that can be closed, passing over the metal traction roller (11) and that is kept taught by the tensioning device (3).

The material to be tested is a nonmetallic mineral, apatite, which is found mixed not in an amalgam with actinolite; it is ground to gradings between 50 and 1000 microns in diameter and then fed with this material to a flow of about 60 kg/hr. The roller was made to rotate in the direction of the fall of the material at an angular speed such that the centrifugal force exercised towards the nonmagnetic and weakly paramagnetic particles would manage to separate one from the other.

At this angular speed, the centrifugal force causes the nonmagnetic material to separate easily from the metal traction roller (11) and be directed by the dividing guide (8) to the drop zone of nonmagnetic material, while the weakly paramagnetic material comes off by gravity or with the help of the centrifugal force in the drop zone of weakly paramagnetic material (7). The moderately paramagnetic material that continues adhered to the periphery of the metal traction roller (11) due to the magnetic force exercised by the plurality of edges of the magnets is separated from the roller by the plastic coating (4) until when at a distance from the magnets it falls due to gravity to the deflector (6) that separates the rest of the other fractions, thus finally obtaining the fractions of separated or concentrated material.

The invention claimed is:

1. A separating device for concentrating ores and other particulate materials, the separating device comprising:

a material feeder for carrying a feed material comprising a fraction of nonmagnetic feed material, a fraction of weakly paramagnetic feed material, and a fraction of moderately paramagnetic feed material, a metal traction roller that rotates in a direction to cause the feed material to fall from the material feeder, wherein a mantle of the metal traction roller is covered substantially completely by a multiplicity of permanent magnets, each having a magnetic axis and a polarity, wherein the permanent magnets are installed in proximity to each other, such that their magnetic axes are perpendicular to a radial axis of the fraction roller and their polarities are oriented at random, a sleeve of nonmagnetic plastic material that covers about 200 sexagesmial degrees of a cross section of the traction roller along the entire width of the traction roller, a first deflector that separates the fraction of moderately paramagnetic feed material from the fraction of weakly paramagnetic feed material during the fall of the feed material from the material feeder, a second deflector positioned on a plane that intersects the traction roller, such than an edge of the deflector is in a zone where the fraction of nonmagnetic feed material moves away from the traction roller during the fall of the feed material from the material feeder, and a tensioning roller positioned between a pulley and the traction roller, wherein the tensioning roller varies an angle of emergence of about 45 sexagesimal degrees from the vertical of the axis of the metal traction roller.

2. The separating device of claim 1, wherein a magnetic force generated by a plurality of edges of the magnets is capable of separating the fraction of weakly paramagnetic feed material from the fraction of nonmagnetic feed material.

3. The separating device of claim 2, wherein the traction roller rotates at an angular speed such that it transfers a kinetic energy to the fraction of weakly paramagnetic feed materials and the fraction of nonmagnetic feed materials in order to separate, by speed translated into distance, the fraction of weakly paramagnetic feed materials from the fraction of nonmagnetic feed materials.

4. The separating device of claim 3, wherein the fraction of nonmagnetic feed material comprises a nonmagnetic particulate ore, and the fraction of weakly paramagnetic feed material and the fraction of moderately paramagnetic feed material comprise an amphibole.

5. The separating device of claim 4, wherein the fraction of nonmagnetic feed material comprises apatite, and the fraction of weakly paramagnetic feed material and the fraction of moderately paramagnetic feed material comprise an actinolite mineral and intermediate forms of actinolite mineral.

6. A separating device for concentrating ores and other particulate materials, the separating device comprising:

a material feeder for carrying a feed material comprising a fraction of nonmagnetic feed material, a fraction of weakly paramagnetic feed material, and a fraction of moderately paramagnetic feed material, a metal traction roller that rotates in a direction to cause the feed material to fall from the material feeder, wherein a mantle of the metal traction roller is covered substantially completely by a multiplicity of permanent magnets, each having a magnetic axis and a polarity, wherein the permanent magnets are installed in proximity to each other, such that their magnetic axes are perpendicular to a radial axis of the fraction roller and their polarities are oriented at random, a sleeve of nonmagnetic plastic material that covers about 200 sexagesmial degrees of a cross section of the traction roller along the entire width of the traction roller, a first deflector that separates the fraction of moderately paramagnetic feed material from the fraction of weakly paramagnetic feed material during the fall of the feed material from the material feeder, a second deflector positioned on a plane that intersects the traction roller, such than an edge of the deflector is in a zone where the fraction of nonmagnetic feed material moves away from the traction roller during the fall of the feed material from the material feeder, and a tensioning roller positioned between a pulley and the traction roller, wherein the tensioning roller varies an angle of emergence in about 45 sexagesimal degrees from the vertical of the axis of the metal traction roller;

wherein the permanent magnets are made of neodymium, wherein the permanent magnets have a magnetic induction of approximately 12,000 gauss and generates a magnetic force of at least about 4,500 gauss.

7. The separating device of claim 6, wherein the sleeve is of plastic material.

8. The separating device of claim 6, wherein the tensioning roller modifies the angle of emergence of the fraction of moderately paramagnetic feed material in about 45 sexagesimal degrees of the vertical of the metal traction roller.

9. The separating equipment device of claim 8, wherein the traction roller separates the fraction of moderately paramagnetic feed material fraction from the fraction of weakly paramagnetic feed material.

* * * * *